United States Patent [19]

Lindén

[11] Patent Number: 4,723,375

[45] Date of Patent: Feb. 9, 1988

[54] DEVICE FOR SHARPENING KNIVES

[75] Inventor: Olavi Lindén, Billnäs, Finland

[73] Assignee: OY Fiskars AB, Helsinki, Finland

[21] Appl. No.: 7,621

[22] Filed: Jan. 28, 1987

[30] Foreign Application Priority Data

Feb. 4, 1986 [FI] Finland ..... 860502

[51] Int. Cl.[4] ..... B24B 9/04

[52] U.S. Cl. ..... 51/102; 51/128; 51/208; 51/210

[58] Field of Search ..... 51/80 BS, 81 BS, 82 BS, 51/91 BS, 92 BS, 102, 111 R, 111 BR, 128, 159, 205 WG, 208, 210, 285; 76/84, 88, 89

[56] References Cited

U.S. PATENT DOCUMENTS

| | | | |
|---|---|---|---|
| 1,342,275 | 6/1920 | Cornell | 51/210 |
| 1,360,998 | 12/1920 | Barber | 51/210 |
| 2,799,125 | 7/1957 | Dicke | 51/102 X |
| 2,898,709 | 8/1959 | Bednarski | 51/128 X |
| 3,332,173 | 7/1967 | McMaster et al. | 51/102 X |
| 3,461,616 | 8/1969 | Nissen et al. | 51/87 R |
| 3,909,985 | 10/1975 | Knecht | 51/128 X |
| 4,050,197 | 9/1977 | Thompson et al. | 51/208 |

*Primary Examiner*—Robert P. Olszewski
*Attorney, Agent, or Firm*—Foley & Lardner

[57] ABSTRACT

A device for sharpening knives, comprising a frame and a grinding element rotatably mounted in the frame. The grinding element is provided with two cone-shaped grinding surfaces turned towards each other. The cone angle of the grinding surfaces varies in the peripheral direction of the grinding element, with at least one portion with a small cone angle having a rougher surface than the portion having a wide cone angle.

13 Claims, 12 Drawing Figures

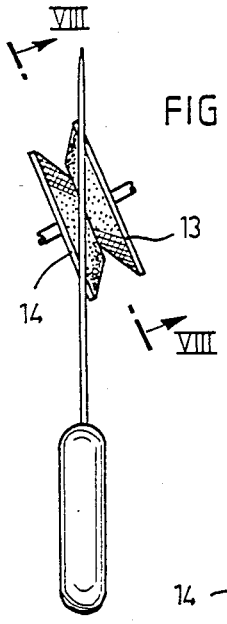
FIG. 7
FIG. 8
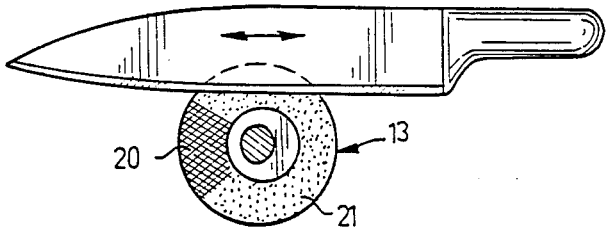
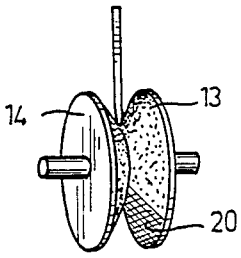
FIG. 9
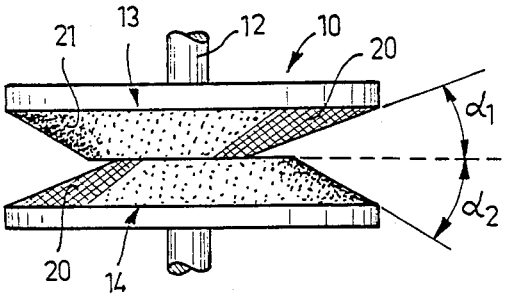
FIG. 10
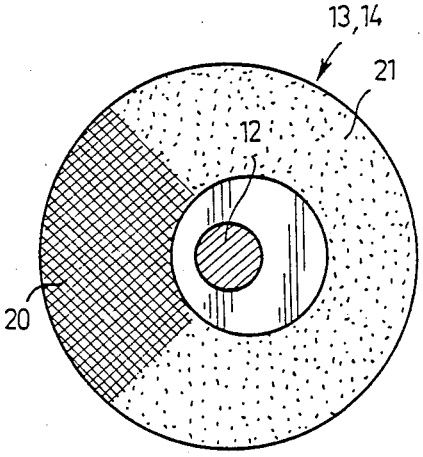
FIG. 11
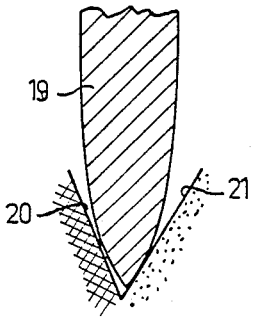
FIG. 12

DEVICE FOR SHARPENING KNIVES

The present invention relates to a device for sharpening knives, comprising a frame, a grinding element rotatably mounted in the frame, which grinding element comprises two grinding surfaces both having the shape of the surface of a truncated cone and forming an angle with each other, and a device for steering a knife into contact with said grinding surfaces so that, during the sharpening process, it bears against both said grinding surfaces.

Devices of this type of construction are, in general, known. For example, U.S. Pat. No. 1,360,998, issued to H. E. Barber on Dec. 7, 1920, describes a sharpener wherein the knife is directed in such a way that the angle between the longitudinal axis of the knife and the axis of rotation of the grinding element is about 70 degrees. Respective grinding surfaces are provided, one for each side of the knife edge, so that both sides of the knife edge are treated simultaneously. When the knife is passed to and fro over the grinding element, the grinding element is rotated, causing the grinding surfaces to grind the edge of the knife. Although the rotation is relatively slow, the grinding is very effective, since the edge of the knife bears against the grinding surfaces substantially over their whole width. The high friction between the edge of the knife and the grinding surfaces allows at the same time use of a rotating grinding element, which may be cleaned with water in a trough arranged below the grinding element. Other devices having a disclosed in U.S. Pat. No. 1,342,275, issued to A. Cornell on June 1, 1920, and U.S. Pat. No. 4,050,197, issued to Thompson, et al, on Sept. 27, 1977.

A common feature of these known sharpening devices is that they grind both sides of the edge at a certain angle in relation to the central plane of the knife blade. Thus a knife blade is obtained which has a sharp transition between the sides of the knife blade and the sides of the edge. This shape of the edge is not the best possible, since the edge angle must thereby be made relatively small. For many applications and considering the durability of the edge, it would be advantageous to have an edge with convex sides which smoothly adjoin the sides of the blade. In this case, the edge angle can be larger than in edges with planar sides.

U.S. Pat. No. 3,461,616 discloses a sharpening device for razor blades and the like which produces a convex edge. The razor blade is passed through a groove between two screw-shaped rotating grinding elements which are positioned partly within each other (interdigitated). The thread height of the screw-shaped elements increases in the direction of one end of the grinding element. Thus, the angle between the grinding surfaces becomes wider, and the edge of the razor blade is ground at various angles as the razor blade is displaced in the longitudinal direction of the screws. This device, however, has a complicated construction and, therefore, is suited primarily only for factory applications.

SUMMARY OF THE INVENTION

The present invention provides a sharpening device for domestic use, which grinds convex edges on both sides of a knife edge. According to the present invention, the cone angle of the grinding surfaces varies in the peripheral direction of said grinding element; that portion or those portions of the grinding surfaces having a small cone angle are provided with a rougher surface than that portion or those portions having a wide cone angle.

Because the cone angle of the grinding surfaces varies, different portions of the grinding surfaces grind different parts of the side surfaces of the edge in such a way that the rough grinding surfaces grind those parts of the edge surfaces which are situated further away from the edge point (apex of the edge) while the portions with a smoother grinding surface grind the sides of the edge close to the edge point. Because of the varying roughness of the grinding surfaces, more material is removed at a distance from the edge point than in the vicinity of the edge point, which provides favorable knife edge shape. Convex knife edge sides are obtained by varying the cone angle evenly from a minimum value to a maximum value, whereby the portion of the grinding surface which bears against the knife edge is continuously relocated between a first end position in the vicinity of the edge point (apex) and a second end position at a distance from the edge point. Thus, a knife edge with convex side surfaces is obtained, which surfaces smoothly adjoin the side surfaces of the blade of the knife.

Since that portion of the grinding surface which has a rough grinding surface works the edge of the knife blade more than the portion having a smoother grinding surface, it has been found to be sufficient if the portion having the rough grinding surface has an angle length of about 90 degrees, with the smooth grinding surface extending over an arch of about 270 degrees.

In order for the knife to stay at a substantially constant distance from the axis of rotation of the grinding element, it is advantageous that the rough portion or portions of one grinding surface be positioned opposite the smooth portion or portions of the other.

BRIEF DESCRIPTION OF THE DRAWINGS

A preferred embodiment of the device according to the invention will be described in more detail in the following with reference to the enclosed drawings, in which FIG. 7 shows schematically the mutual position of the grinding element and the knife, FIG. 8 shows a section along the line VIII—VIII in FIG. 7, FIG. 9 shows the knife and the grinding element seen in the longitudinal direction of the knife, FIG. 10 is an enlarged side view of the grinding element according to the invention, FIG. 11 is an end view of one conic portion of the grinding element, and FIG. 12 shows schematically the contact between the knife and the grinding surfaces.

DETAILED DESCRIPTION OF A PREFERRED EXEMPLARY EMBODIMENT

Figure 1:
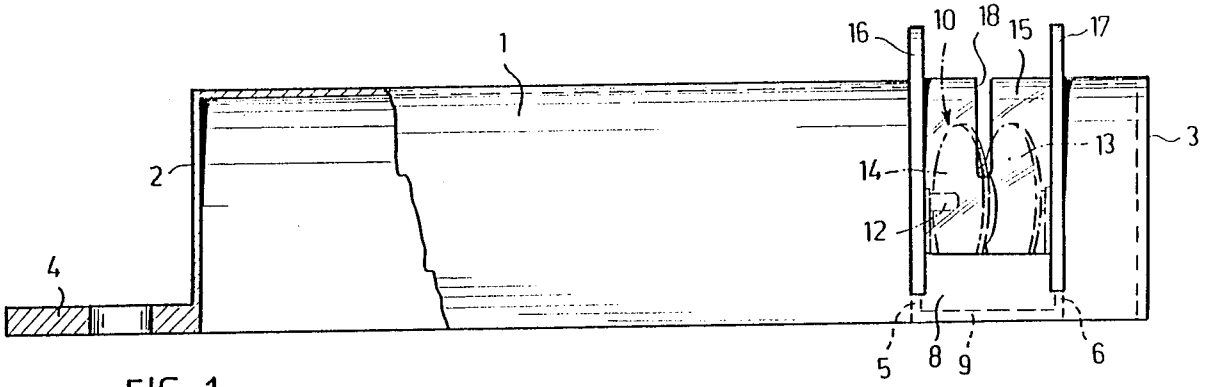
FIG. 1 is a side view of a device in accordance with the present invention.

Referring to FIGS. 1 to 4, a sharpening device in accordance with the present invention comprises a substantially semi-cylindrical frame 1 having end surfaces 2 and 3, and a fastening ear 4 having an opening which enables the hanging of the device on a nail or the like.

All portions of the frame are preferably made of a rigid plastic.

In the vicinity of end surface 3, frame 1 is provided with a recess (best seen in FIG. 4), defined by two walls 5 and 6 parallel with end surfaces 2 and 3, two low side walls 7 and 8, and a bottom 9 which connects walls 5–8 with each other. Walls 5–8 and bottom 9 together form a waterproof trough, the upper edge of which is formed by the upper edges of the side walls 7 and 8.

A grinding element 10 is arranged in the recess between the walls 5, 6. The grinding element consists of a wheel which is rotatably mounted with an asix of rotation 12, in bearings 11 disposed on those sides of walls 5, 6 which are turned towards each other.

The grinding element 10 is formed in such a way that its peripheral surface forms two grinding surfaces 13 and 14. Grinding surfaces 13 and 14 are turned towards each other, and both correspond in shape to a truncated cone. Grinding element 10 is preferably made of a ceramic material, for example, aluminium oxide or tungsten, or of metal.

Figure 5:
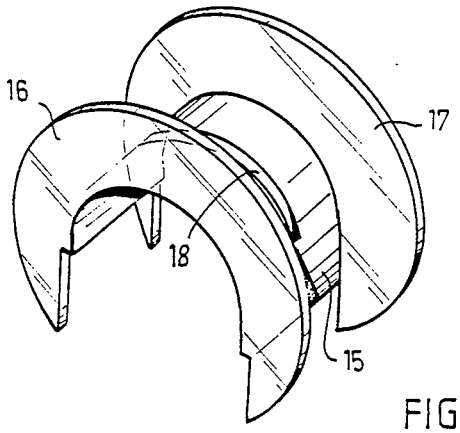
FIG. 5 is a perspective view of the lid.

With reference to FIGS. 1–3 and 5, and particularly to FIG. 5, the recess in which the grinding element is positioned is covered with a transparent plastic lid 15 having the same arch shape as frame 1. Longitudinal edges of lid 15 bear against a groove (not shown) in the outer surface of the frame. Lid 15 extends from the upper edge of side wall 7 up over grinding element 10 and down again to the upper edge of side wall 8. The longitudinal edges of the lid, i.e., the edges which are parallel with the end surfaces of the frame, are provided with protruding rounded protective flanges 16 and 17, which extend down over side walls 7 and 8 and which contribute to the snap-locking of the lid on frame 1.

Figure 6:
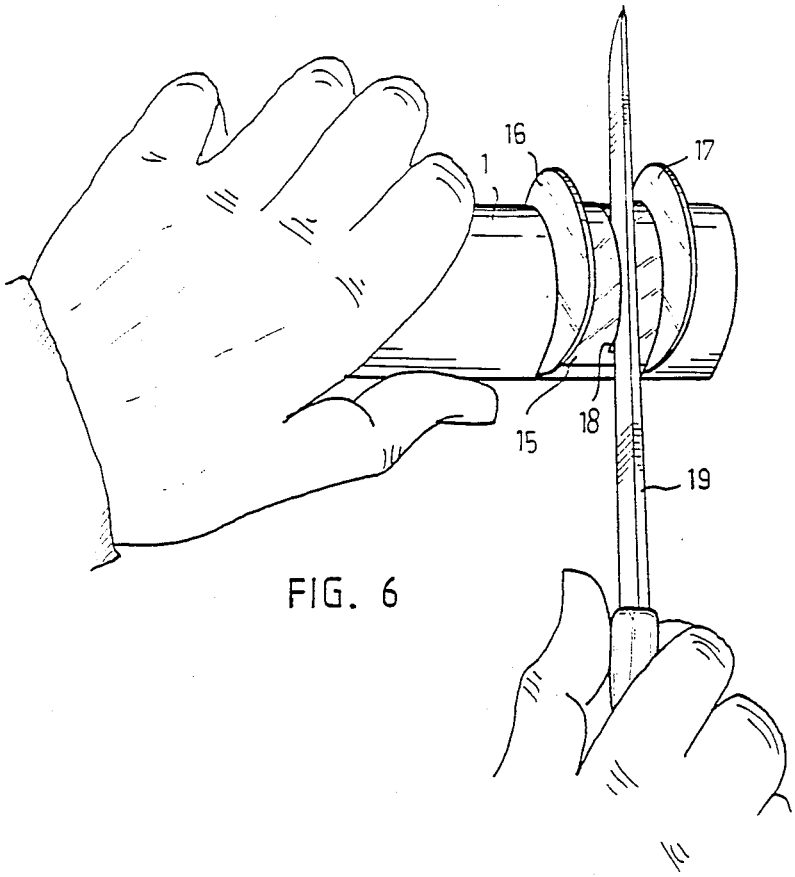
FIG. 6 shows the sharpening of a knife.

Lid 15 is provided with a slit 18, extending over a part of the length of the lid and disposed transversely with respect to the longitudinal axis of frame 1. Slit 18 is adapted to receive a knife 19 to be sharpened (FIG. 6), and is sufficiently wide to receive knives of a normal thickness. As is shown in FIG. 1, the slit ends are preferably positioned at a point slightly above the horizontal plane of the axis of the grinding element.

Figure 2:
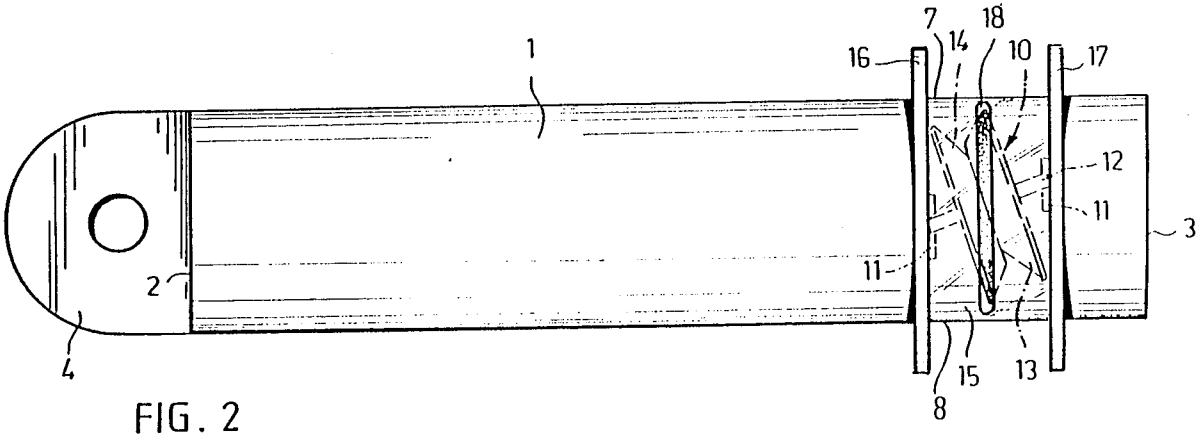
FIG. 2 is a planar view of the device.
Figure 3:
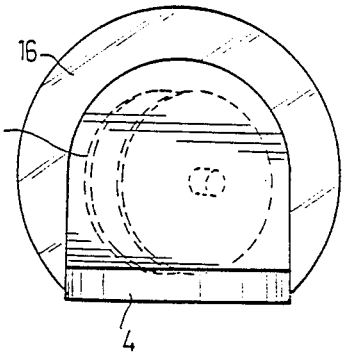
FIG. 3 is an end view of the device.
Figure 4:
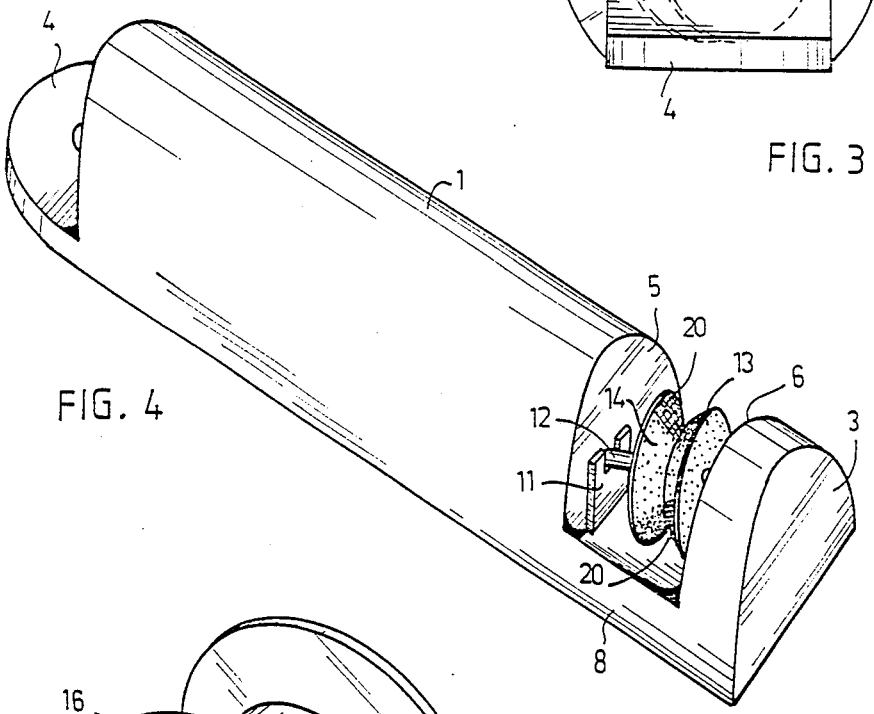
FIG. 4 is a perspective view of the device.

As best seen in FIG. 2, the axis of rotation 12 of the grinding element 10 is inclined with respect to the longitudinal axis of the frame, with the result that knife 19, when inserted into slit 18, does not follow the contact line (i.e., juncture) between grinding surfaces 13 and 14; rather, knife 19 contacts one of the grinding surfaces on one side of axis 12, and the other grinding surface on the opposite side of axis 12. The angle between grinding surfaces 13 and 14 and the angle between slit 18 and axis of rotation 12 are chosen so that the contours of the grinding surfaces, seen in the longitudinal direction of the knife or the slit 18, cross each other, i.e., the grinding surface positioned further back disappears partly behind the grinding surface positioned in the front.

FIGS. 7 to 9 show schematically how knife 19 bears against grinding element 10. Especially, FIG. 7 shows that, due to the overlapping of the grinding surfaces, the knife does not contact the common periphery (i.e., juncture) of the grinding surface; instead, it contacts the grinding surfaces above the periphery.

FIGS. 10 and 11 show on an enlarged scale how grinding element 10 according to the invention is constructed. The angle of the grinding surfaces 13, 14 with respect to a plane perpendicular to the axis 12 varies evenly between a minimum value $\alpha_1$, to a maximum value $\alpha_2$. Minimum value $\alpha_1$ may be 20 to 25 degrees, preferably 27 degrees. That portion of the grinding surfaces which has the smallest angle to the plane is, according to the invention, provided with a relatively rough surface which effectively works the side surfaces of the knife edge. This portion is indicated with the reference number 20, and it has an angle length of about 90 degrees. From this portion, in the middle of which the inclination angle is $\alpha_1$, the inclination angle grows continuously in the peripheral direction of the surface until it reaches the value $\alpha_2$. That portion 21 of the grinding surface which is positioned outside portion 20 is smoother than portion 20 and, thus, does not work the knife edge as much as portion 20.

As is shown in FIG. 12, portion 20, having a small inclination angle $\alpha_1$, works a portion of the knife edge positioned at a distance from the edge point (apex), whereas portion 21, with a wider inclination angle, works the portion close to the point of the edge.

As is shown in FIG. 10, grinding surfaces 13, 14 are relatively disposed so that portion 20 on one of the grinding surfaces is positioned as far away as possible from portion 20 on the other grinding surface. Thus, both the portions 20 are positioned opposite a portion 21.

As an alternative to the above, the grinding surfaces 13, 14 may be provided with two or more mutually spaced rough surface portions 20, whereby the grinding surfaces obtain a wave shape. The angle length of the portion 20 may naturally differ from the length shown in the drawings.

What is claimed is:

1. A device for sharpening knives, comprising:
a frame;
a grinding element rotatably mounted in the frame;
said grinding element comprising first and second truncated cone-shaped grinding surfaces extending in a peripheral direction disposed to form an angle with each other; and
means for steering a knife into contact with said grinding surface so that, during the sharpening process, the knife bears against both of said grinding surfaces;
said grinding surfaces having cone angles varying in the peripheral direction of said grinding element, and including at least one portion having a relatively small cone angle and a rougher surface than portions of the surface having a wider cone angle.

2. A device according to claim 1, wherein said cone angles vary evenly from a minimum value to a maximum value.

3. A device according to claim 1, wherein said cone angles vary between 20 and 30 degrees.

4. A device according to claim 1, wherein said grinding surfaces comprise one portion having a rough surface and one portion having a smooth surface, said rough surface portion having an angle length of about 90 degrees.

5. A device according to claim 1, wherein the grinding surfaces of said grinding element are disposed so that said portion of said first grinding surface having a rough surface is positioned opposite to a portion of said second grinding surface having a smooth surface.

6. A device according to claim 3 wherein said cone angles vary between 23 and 27 degrees.

7. A device according to claim 1, including a plurality of said rougher surface portions.

8. The device of claim 7, wherein the grinding surfaces of said grinding element are disposed so that each portion of said first grinding surface having a rough surface is positioned opposite to a portion of said second grinding surface having a smooth surface.

9. A device for sharpening knives, comprising:

a frame;

a grinding element, rotatably mounted in said frame, said grinding element comprising first and second truncated cone-shaped grinding surfaces, disposed to form an angle with each other;

each of said grinding surfaces defining a plurality of cone angles including at least one portion having a relatively rough surface and at least one portion having a relatively smooth surface, the cone angle of said rough surface portion being less than the cone angle of adjacent portions of said grinding surface; and means for steering a knife into contact with both said grinding surfaces.

10. The device of claim 9, wherein the cone angle of said rough surface portion decreases continuously from the respective adjacent portions of said surface to a minimum value at approximately the center of said rough surface portion.

11. The device of claim 10 wherein said respective adjacent portions have relatively smooth surfaces.

12. The device of claim 9, wherein said means for steering comprises means for bringing the knife into contact with said first grinding surface on one side of the axis of rotation of said grinding element and into contact with said second grinding surface on the opposite side of the axis of rotation of said grinding element.

13. The device of claim 12, wherein the rough surface portion of said first grinding surface is disposed opposite to a said smooth surfaced portion of said second grinding surface.

* * * * *